US006048076A

United States Patent [19]

Lin

[11] Patent Number: 6,048,076

[45] Date of Patent: Apr. 11, 2000

[54] LAMP ASSEMBLY

[76] Inventor: Mei-Lu Lin, 56, Min Sheng Street, Fengyuan, Taichung, Taiwan

[21] Appl. No.: 09/093,624

[22] Filed: Jun. 6, 1998

Related U.S. Application Data

[63] Continuation-in-part of application No. 08/832,069, Apr. 2, 1997, abandoned.

[51] Int. Cl.[7] ..... F21V 19/00

[52] U.S. Cl. ..... 362/249; 362/806

[58] Field of Search ..... 362/249, 267, 362/123, 226, 252, 391, 806

[56] References Cited

U.S. PATENT DOCUMENTS 4,667,276 5/1987 Cheng ..... 362/806

5,893,634 4/1999 Wang ..... 362/249

5,913,600 6/1999 Lin ..... 362/391

*Primary Examiner*—Y. Quach

[57] ABSTRACT

A lamp device has a bulb disposed on a lamp holder, a conductive plate connected to the lamp holder, and a socket shell receiving the lamp holder. The socket shell has a through hole, a hollow outer casing, a bar, two grooves, two slots, and a recess. A first copper plate is connected to a first main wire. A second copper plate is connected to a second main wire. The hollow outer casing has an inner annular rib and two notches. The socket shell is inserted in the hollow outer casing. The inner annular rib blocks an upper face of the socket shell. The first and the second copper plates are inserted in the grooves to contact the conductive plate. A secondary wire passes through the respective notches and the respective slots.

1 Claim, 9 Drawing Sheets

LAMP ASSEMBLY

The present invention is a continuation-in-part of application Ser. No. 08/832,069, filed Apr. 2, 1997, now abandoned.

BACKGROUND OF THE INVENTION

This invention relates to a lamp assembly, and more particularly, this invention relates to a lamp assembly which contains a plurality of lamp devices.

A conventional lamp assembly for a Christmas tree has a plurality of outer casings. However, each outer casing should position two additional wires in addition to two connected wires. Each outer casing has two lugs to position two additional wires.

SUMMARY OF THE INVENTION

An object of this invention is to provide a lamp assembly which is easily assembled.

Another object of this invention is to provide a lamp assembly which can position a plurality of wires stably.

Another object of this invention is to provide a lamp assembly which can form a net.

DETAILED DESCRIPTION OF THE INVENTION

Figure 1:
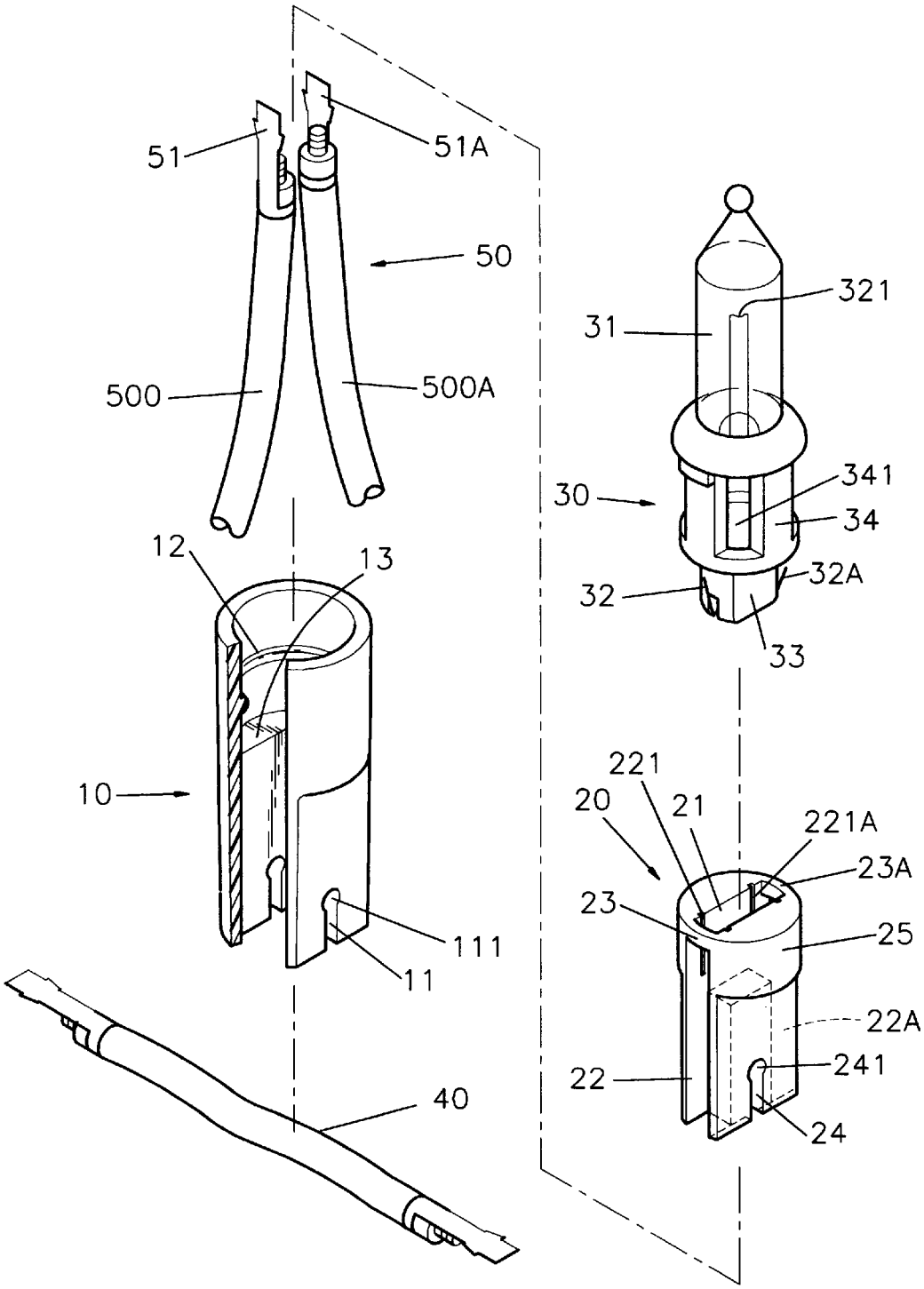
FIG. 1 is a perspective exploded view of a lamp device of a preferred embodiment.
Figure 2:
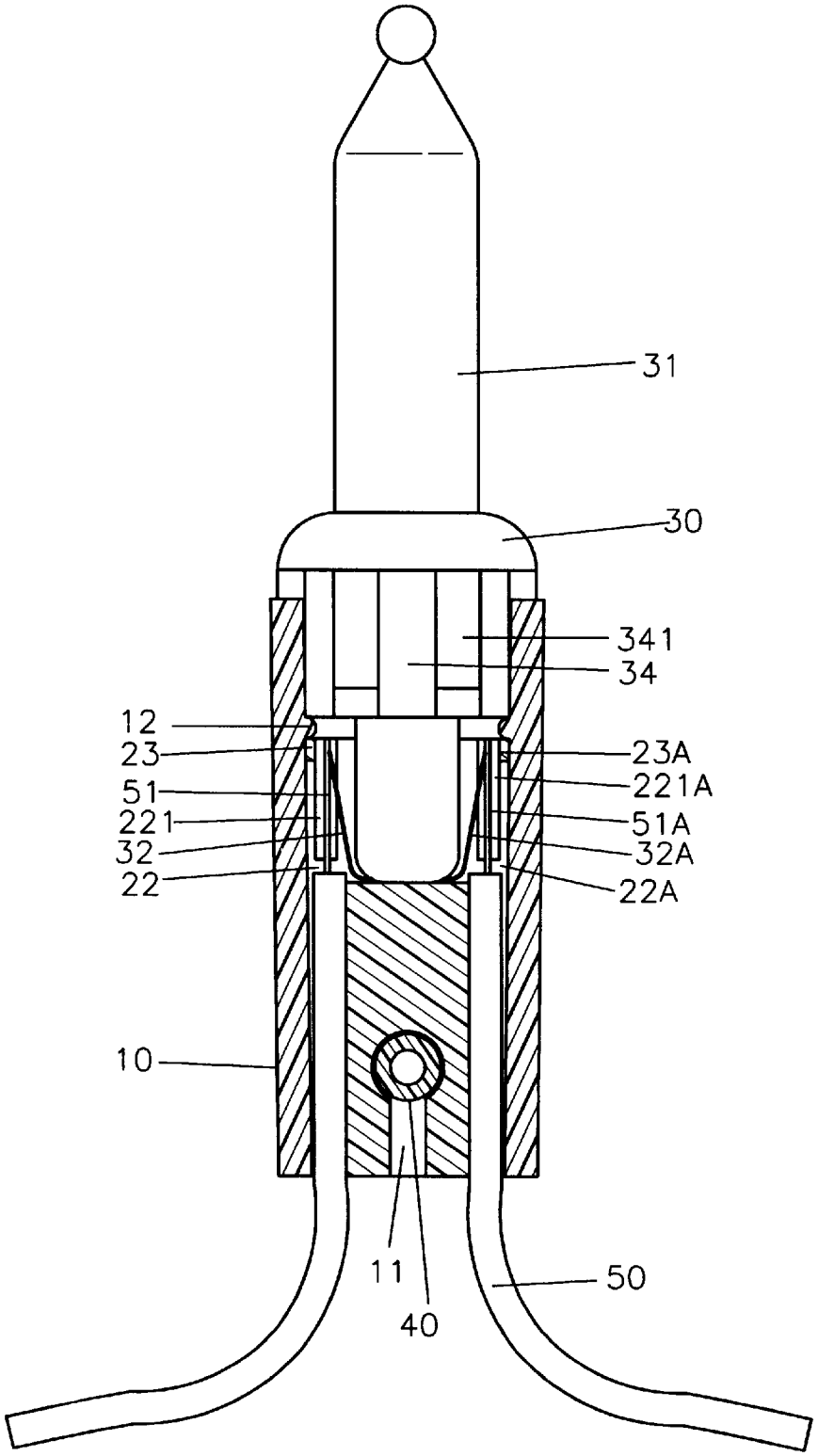
FIG. 2 is a cross-sectional view of a lamp device of a preferred embodiment.
Figure 3:
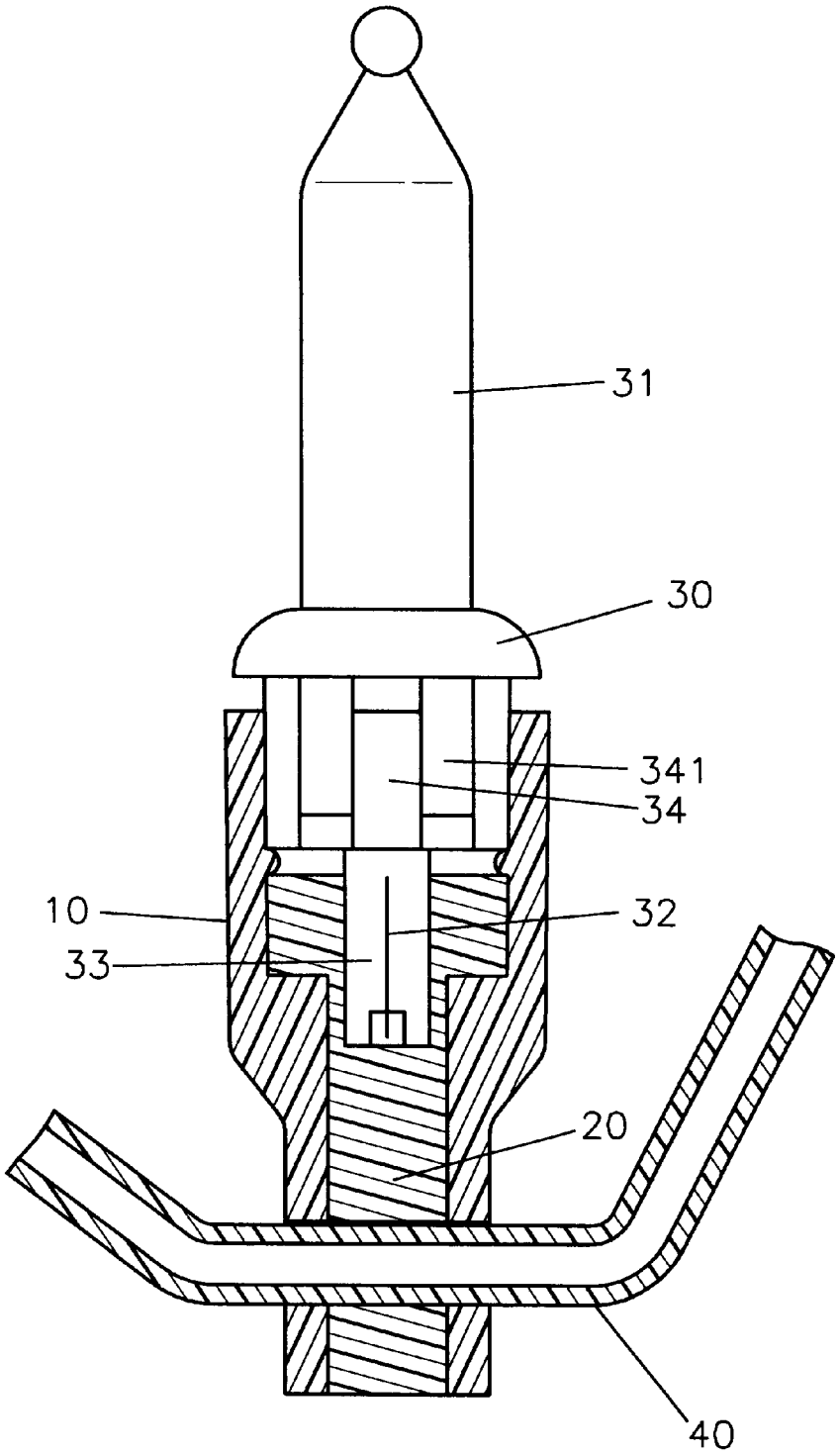
FIG. 3 is another cross-sectional view of a lamp device of a preferred embodiment.
Figure 4:
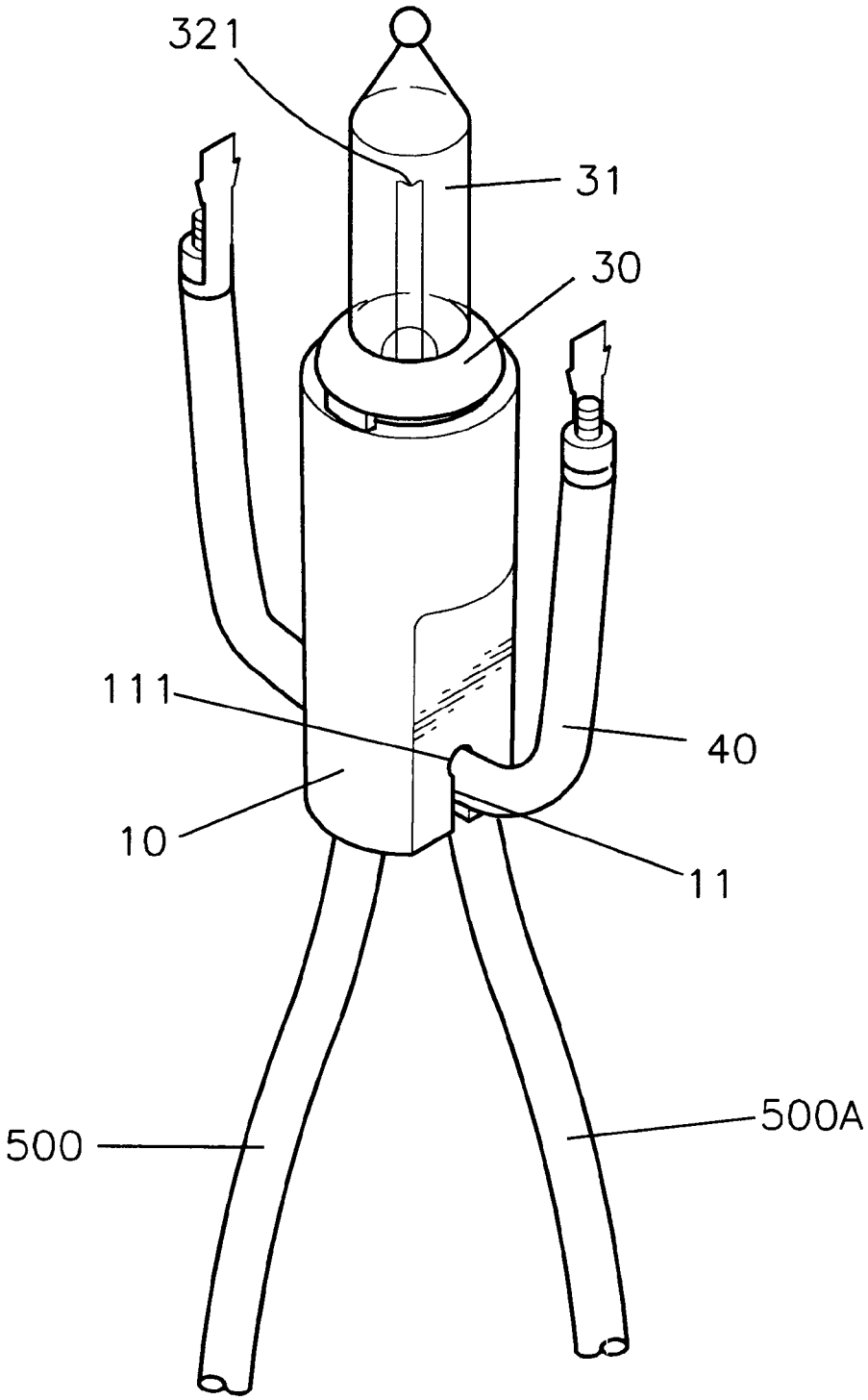
FIG. 4 is a perspective assembly view of a lamp device of a preferred embodiment.

Referring to FIGS. 1 to 4, a lamp device has a bulb 31 disposed on a lamp holder 30, a socket shell 20 receiving the lamp holder 30, the socket shell 20 having a through hole 21 to receive a base portion 33 of the lamp holder 30", and a hollow outer casing 10 enclosing the socket shell 20.

A filament 321 is disposed in the bulb 31. A first lead-in wire 32 and a second lead-in wire 32A are connected to the filament 321.

The lamp holder 30 has a base portion 33, and a hollow cylinder 34 having a plurality of slot holes 341. A distal end of the first lead-in wire 32 extends out of the base portion 33. A distal end of the second lead-in wire 32A extends out of the base portion 33.

The socket shell 20 has a head portion 25, a through hole 21 receiving the base portion 33, a first crossbar 23, a second crossbar 23A, a first groove 22 communicating with the through hole 21, a second groove 22A communicating with the through hole 21, a first recess 221 communicating with the through hole 21, a second recess 221A communicating with the through hole 21, two semicircular apertures 241, and two slots 24. Each semicircular aperture 241 communicates with the respective slot 24. A main wire set 50 has a first main wire 500 and a second main wire 500A. A first copper plate 51 is connected to the first main wire 500. A second copper plate 51A is connected to the second main wire 500A. The first recess 221 receives the first copper plate 51. The second recess 221A receives the second copper plate 51A. The first groove 22 receives the first main wire 500. The second groove 22A receives the second main wire 500A.

The hollow outer casing 10 has two block walls 13, an inner annular rib 12, two semicircular holes 111, and two notches 11. Each semicircular hole 111 communicates with the respective notch 11. The socket shell 20 is inserted in the hollow outer casing 10. The inner annular rib 12 blocks an upper face of the socket shell 20. The first copper plate 51 is inserted in the first groove 22 to contact the first lead-in wire 32. The second copper plate 51A is inserted in the second groove 22 to contact the second lead-in wire 32A. A secondary wire 40 passes through the notches 11 and the slots 24. The The secondary wire 40 only passes through the lamp device but does not have any electrical communication with the lamp device. The first crossbar 23 prevents the first groove 22 from expanding too large. The second crossbar 23A prevents the second groove 22A from expanding too large.

Figure 5:
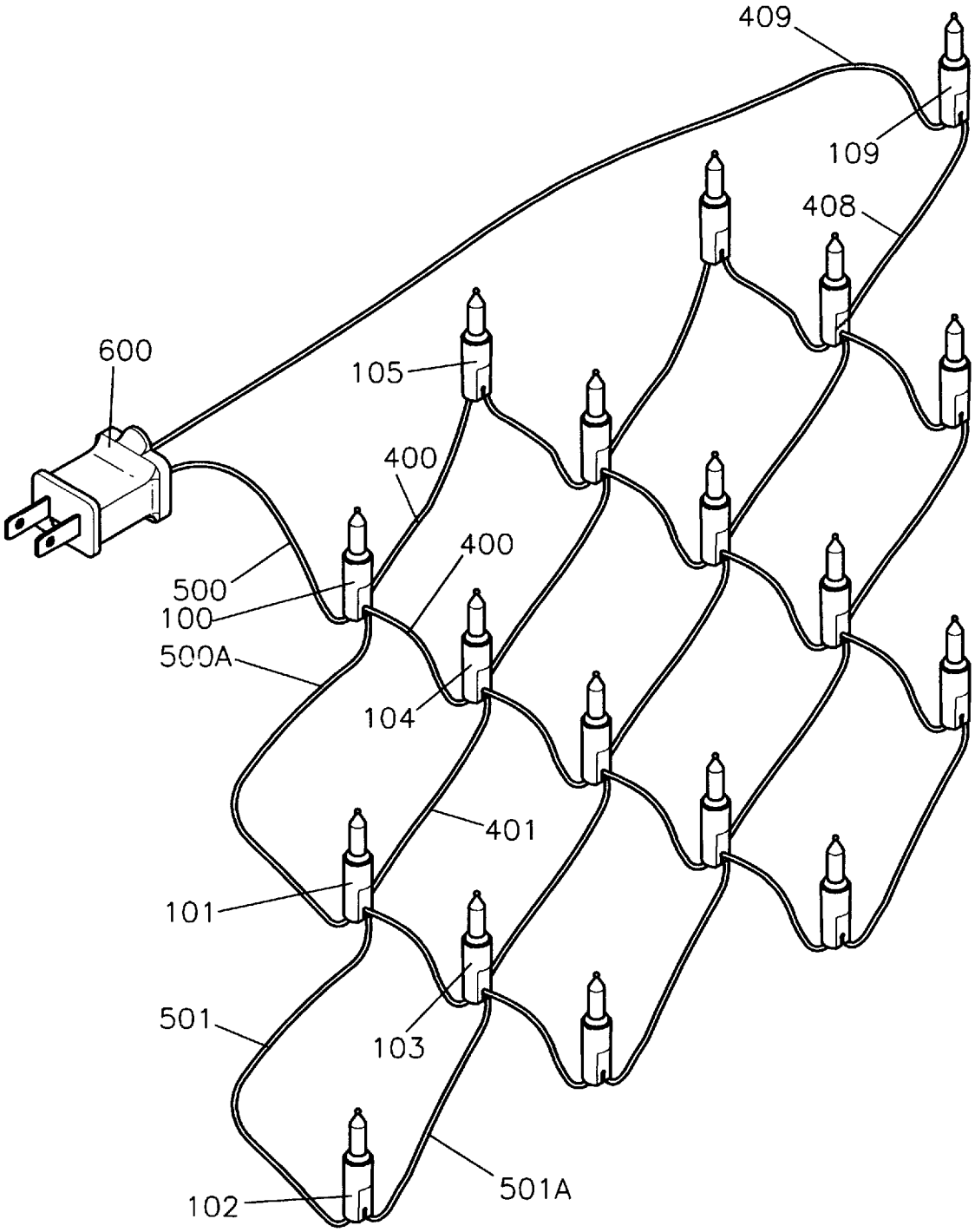
FIG. 5 is a schematic view of a plurality of lamp devices of a preferred embodiment.
Figure 5A:
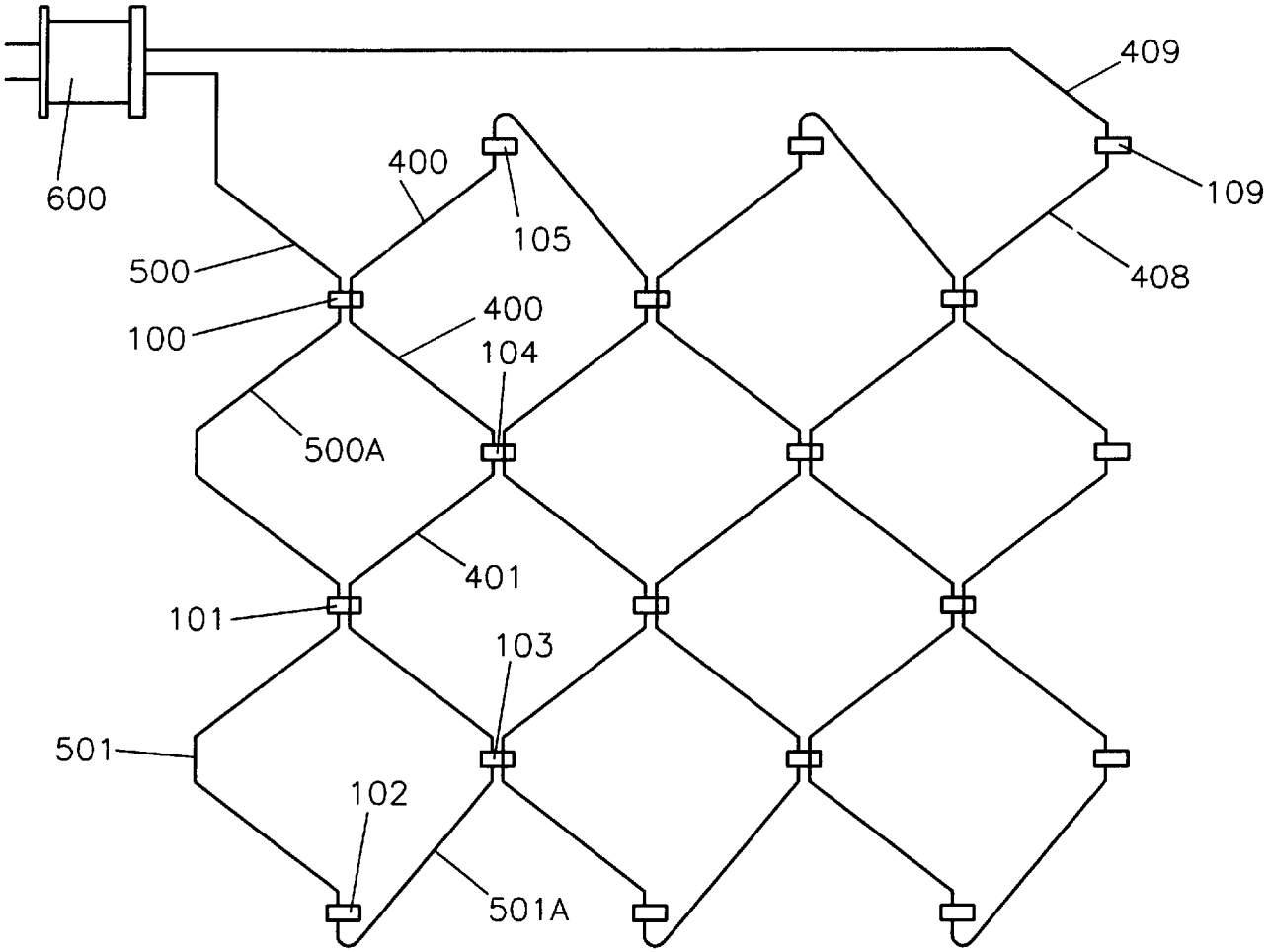
FIG. 5A is a perspective assembly view of a plurality of lamp devices of a preferred embodiment.

Referring to FIGS. 5 and 5A, a lamp assembly comprises a plurality of lamp devices. A first main wire 500 and a second main wire 500A are inserted in a first lamp device 100. The second main wire 500A and a third main wire 501 are inserted in a second lamp device 101. The third main wire 501 and a fourth main wire 501A are inserted in a third lamp device 102. The fourth main wire 501A and a first secondary wire 401 are inserted in a fourth lamp device 103. The first secondary wire 401 and a second secondary wire 400 are inserted in a fifth lamp device 104. The second secondary wire 400 is inserted in a sixth lamp device 105. A last secondary wire 408 and an electric source wire 409 are inserted in a last lamp device 109. The electric source wire 409 is connected to a plug 600.

The first main wire 500 and the second main wire 500A having electrical communication with the first lamp device 100 while the second secondary wire 400 having electric current passing through but does not have any electrical contact with the first lamp device 100. The above mentioned electrical structure is commonly known as in series type of electric inductivity.

Figure 6:
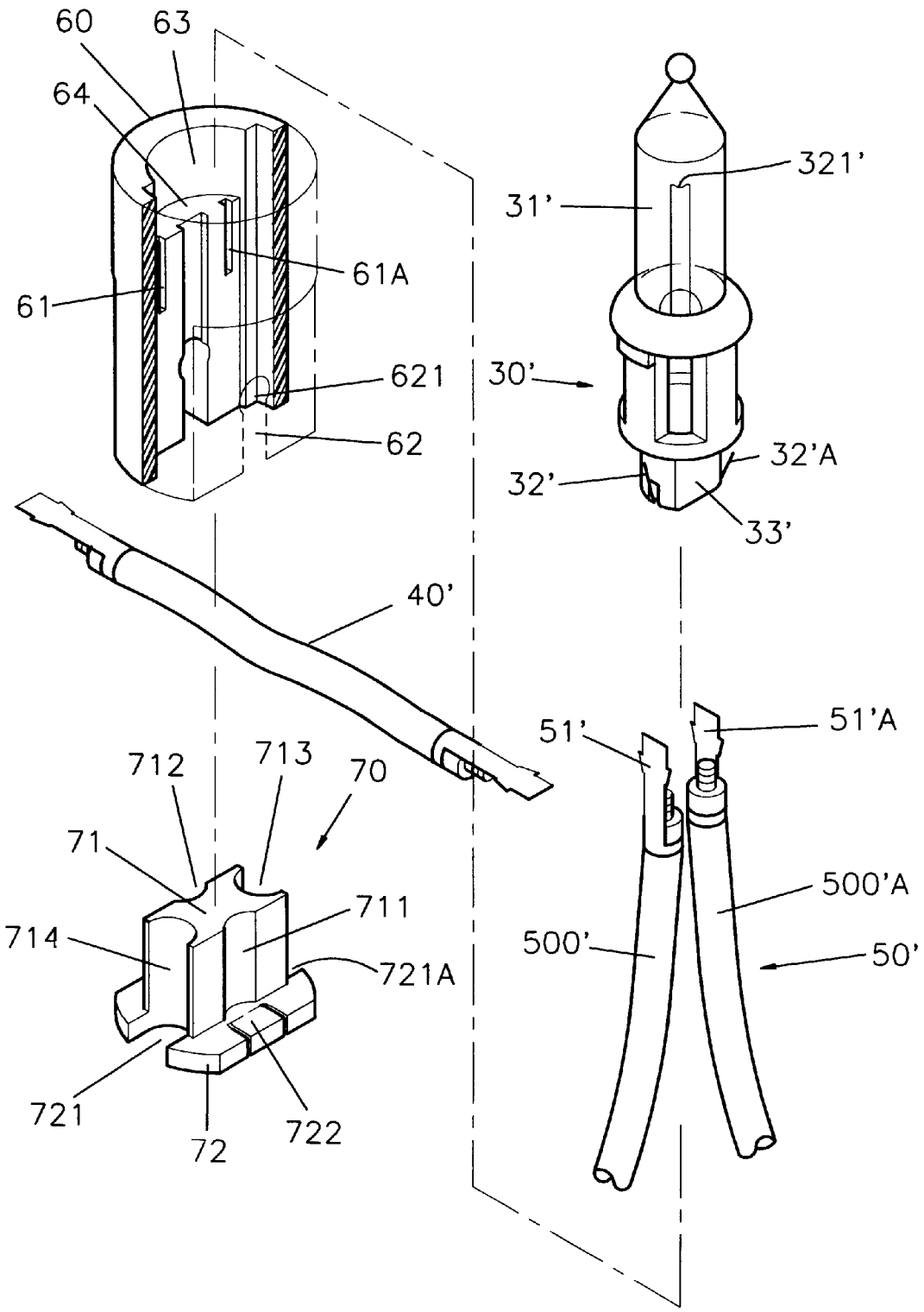
FIG. 6 is a perspective exploded view of a lamp device of another preferred embodiment.
Figure 7:
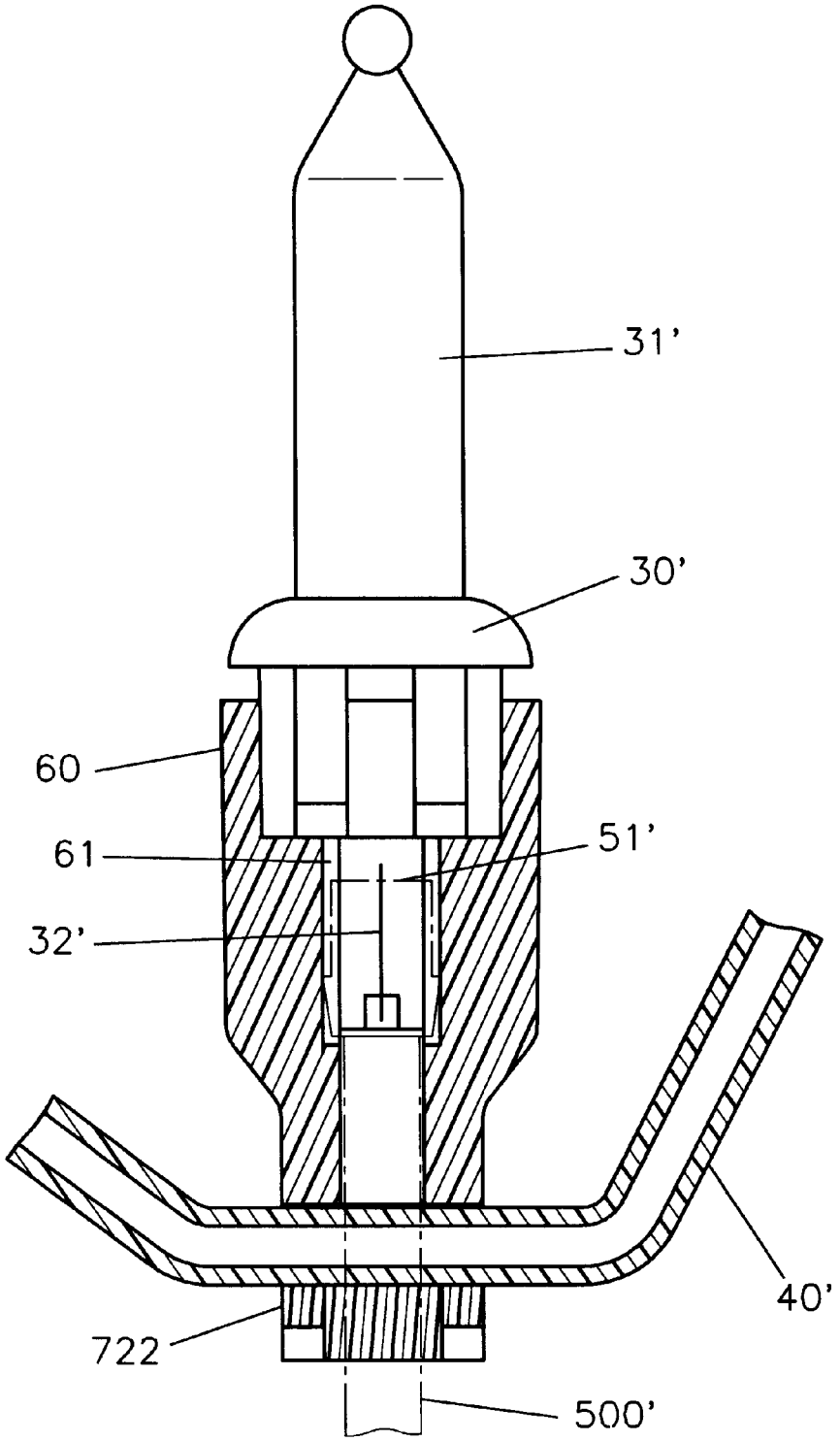
FIG. 7 is a cross-sectional view of a lamp device of another preferred embodiment.
Figure 8:
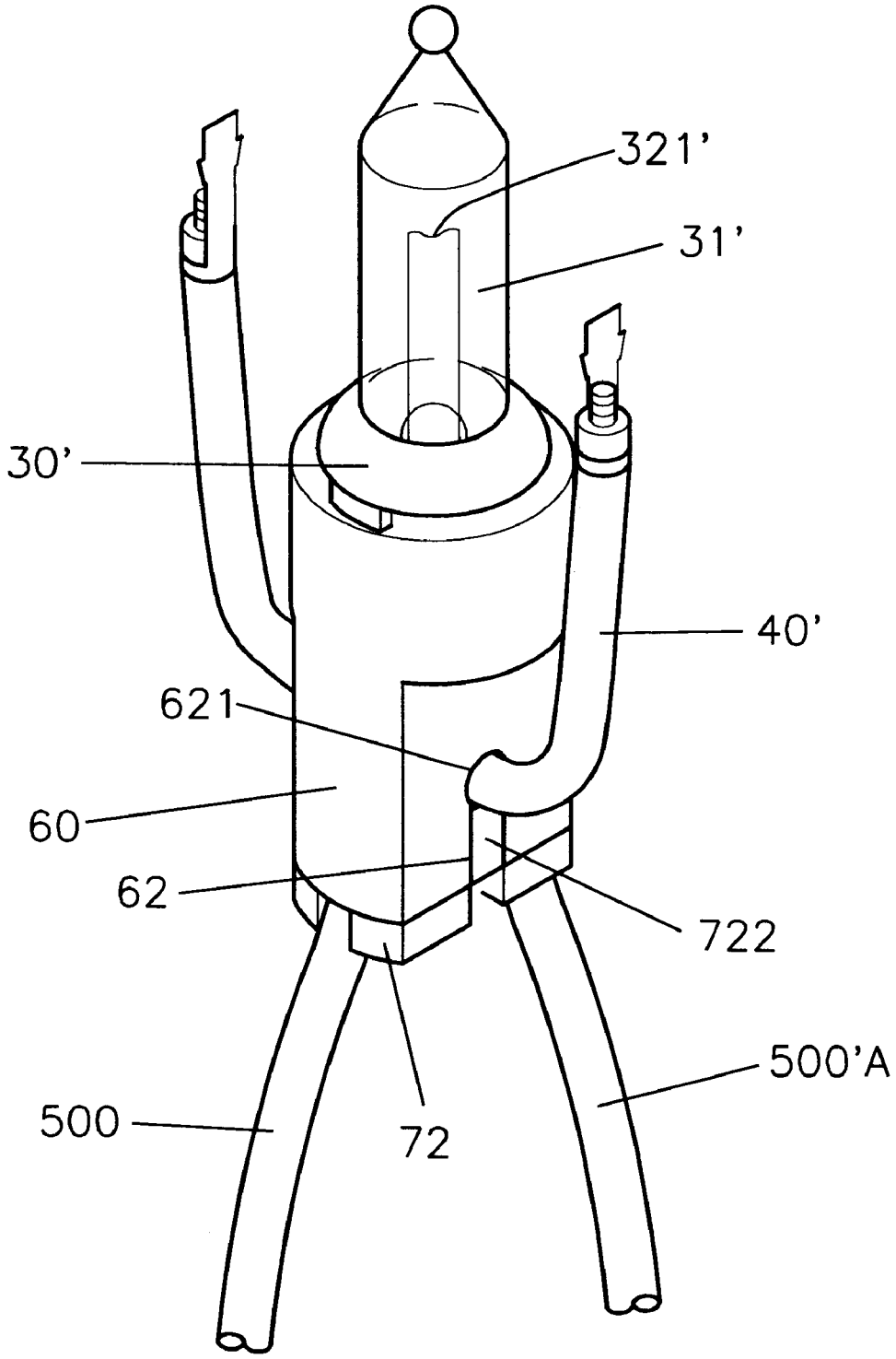
FIG. 8 is a perspective assembly view of a lamp device of another preferred embodiment.

Referring to FIGS. 6 to 8, another lamp device has a bulb 31' disposed on a lamp holder 30', a base portion 33' a conductive connected to the lamp holder 30', and a socket shell 60 having a through hole 63 to receive the lamp holder 30'.

A seat 70 has a plug 71, a base plate 72, and two bendable plates 722. The plug 71 has a first groove 711, a second groove 712, a third groove 713, a fourth groove 714, a first notch 721, and a second notch 721A. The plug 71 is inserted in the socket shell 60 and the base plate 72 blocks the socket shell 60.

A filament 321' is disposed in the bulb 31'. A first lead-in wire 32' and a second lead-in wire 32'A are connected to the filament 321'.

The lamp holder 30' has a base portion 33'. A distal end of the first lead-in wire 32' extends out of the base portion

33'. A distal end of the second lead-in wire 32'A extends out of the base portion 33'.

A main wire set 50' has a first main wire 500' and a second main wire 500'A. A first copper plate 51' is connected to the first main wire 500'. A second copper plate 51'A is connected to the second main wire 500'A.

The socket shell 60 has a hollow interior 63, two block walls 64, a first recess 61, a second recess 61A, two semicircular holes 621, and two notches 62. Each semicircular hole 621 communicates with the respective notch 62. The first recess 61 receives the first copper plate 51'. The second recess 61A receives the second copper plate 51'A. A secondary wire 40' passes through the slots 62'. The bendable plates 722 are bended to position the secondary wire 40'.

I claim:

1. A lamp device comprises a bulb disposed on a lamp holder, a socket shell receiving the lamp holder, the socket shell having a through hole to receive a conductive plate, a hollow outer casing enclosing the socket shell, a filament disposed in the bulb, a first lead-in wire and a second lead-in wire connected to the filament, the lamp holder having a base portion, and a hollow cylinder having a plurality of slot holes, a distal end of the first lead-in wire extending out of the base portion, a distal end of the second lead-in wire extending out of the base portion, the socket shell having a head portion, said through hole receiving the base portion, a first crossbar, a second crossbar, a first groove communicating with the through hole, a second groove communicating with the through hole, a first recess communicating with the through hole, a second recess communicating with the through hole, two semicircular apertures, and two slots, each said semicircular aperture communicating with the respective slot, a main wire set having a first main wire and a second main wire, a first copper plate connected to the first main wire, a second copper plate connected to the second main wire, the first recess receiving the first copper plate, the second recess receiving the second copper plate, the first groove receiving the first main wire, the second groove receiving the second main wire, the hollow outer casing having two block walls, an inner annular rib, two semicircular holes, and two notches, each said semicircular hole communicating with the respective notch, the socket shell inserted in the hollow outer casing, the inner annular rib blocking an upper face of the socket shell, the first copper plate inserted in the first recess to contact the first lead-in wire, the second copper plate inserted in the second recess to contact the second lead-in wire, a secondary wire passing through the notches, the holes and the slots, and wherein the secondary wire only passes through the lamp device but does not have any electrical communication with the lamp device.

* * * * *